US009578694B2

(12) United States Patent
Meusburger et al.

(10) Patent No.: US 9,578,694 B2
(45) Date of Patent: Feb. 21, 2017

(54) VENTILATION SYSTEMS AND METHODS FOR OPERATING THE SAME

(71) Applicant: General Electric Company, Schenectady, NY (US)

(72) Inventors: Eric Xavier Meusburger, Louisville, KY (US); Bangyong Keum, Louisville, KY (US)

(73) Assignee: Haier U.S. Appliance Solutions, Inc., Wilmington, DE (US)

( * ) Notice: Subject to any disclaimer, the term of this patent is extended or adjusted under 35 U.S.C. 154(b) by 320 days.

(21) Appl. No.: 14/309,932

(22) Filed: Jun. 20, 2014

(65) Prior Publication Data

US 2015/0373789 A1 Dec. 24, 2015

(51) Int. Cl.
*H05B 6/64* (2006.01)

(52) U.S. Cl.
CPC ..... *H05B 6/6423* (2013.01)

(58) Field of Classification Search
CPC ..... H05B 6/6423
USPC ..... 99/325, 337; 126/214 R, 299 D, 299 R; 219/702, 757
See application file for complete search history.

(56) References Cited

U.S. PATENT DOCUMENTS 3,131,687 A 5/1964 Kalla
3,292,525 A 12/1966 Jensen
4,705,457 A * 11/1987 Belusa ..... F04D 27/00 236/49.3
6,072,169 A * 6/2000 Kang ..... F24C 15/2042 126/273 A
7,503,842 B2 3/2009 Lee et al.
2007/0298704 A1* 12/2007 Weidmann ..... F24F 7/06 454/229
2008/0067167 A1 3/2008 Sung et al.
2010/0095949 A1 4/2010 Huang
2010/0256821 A1* 10/2010 Jeung ..... F24F 11/047 700/276
2013/0008429 A1* 1/2013 Colburn ..... F24C 15/2028 126/299 D

FOREIGN PATENT DOCUMENTS

WO WO 2013/129786 9/2013

* cited by examiner

*Primary Examiner* — Thien S Tran
(74) *Attorney, Agent, or Firm* — Dority & Manning, P.A.

(57) ABSTRACT

Ventilation systems and methods are provided. A method for operating a ventilation system includes receiving a fan speed of a first fan of a range appliance, the first fan operable to flow air through a first conduit of an air curtain assembly of the range appliance, the first conduit defined in a cabinet of the range appliance. The method further includes determining a corresponding fan speed for a second fan, the second fan operable to flow air through a second conduit of a vent appliance. The method further includes outputting the corresponding fan speed to the second fan. The corresponding fan speed for the second fan is correlated with the fan speed of the first fan such that a volumetric flow rate through the second conduit is greater than or equal to a volumetric flow rate through the first conduit.

18 Claims, 4 Drawing Sheets

VENTILATION SYSTEMS AND METHODS FOR OPERATING THE SAME

FIELD OF THE INVENTION

The present subject matter relates generally to ventilation systems and associated methods, and more particularly to ventilation systems for range appliances which utilize air curtain assemblies.

BACKGROUND OF THE INVENTION

Range appliances are frequently utilized in a variety of settings to cook food items. During operation of a range appliance, relatively high temperatures can be generated, for example, in the cooking chamber or on the cooktop of the range appliance. In many cases, the high temperatures generated by the range appliance can cause smoke or other exhaust fumes to emanate from the range appliance. Accordingly, attempts have been made to capture such fumes during range appliance operation. For example, in some cases, hoods have been installed generally above range appliances. In other cases, over-the-range microwave appliances have been installed generally above range appliances. These hoods and over-the-range microwave appliances may include circulation systems. When activated, a circulation system can draw fumes, smoke, grease, and/or steam away from the cooktop of the oven range appliance. Circulation systems generally include a fan for drawing a flow of air into the circulation system and a grease filter for trapping grease entering the circulation system. Certain over-the-range microwave appliances also include air filters for filtering air passing through the microwave appliances' circulation systems. The circulation assembly's air filter can assist with removing dust, particulates, and/or other undesirable substances from air passing therethrough.

Recently, manufacturers have begun to include air curtain features in range appliances. Such air curtain features typically direct a flow of air from the range appliance towards a venting apparatus, such as a hood or over-the-range microwave appliance. Such air flow can direct exhaust fumes generally towards the venting apparatus, to facilitate improved venting. However, operation of a venting apparatus is typically independent of the operation of an associated range appliance (and air curtain features thereof). As such, in many cases, the additional air flow directing exhaust fumes generally towards the venting apparatus can overwhelm the venting apparatus, by providing excess air and fumes beyond what the venting apparatus can handle. This can be counter-effective, causing fumes to not be contained by the venting apparatus.

Accordingly, improved venting systems and associated methods are desired in the art. In particular, venting systems and methods which reduce or eliminate the venting apparatus over-capacity issues, and which facilitate improved air quality conditions as a result, would be advantageous.

BRIEF DESCRIPTION OF THE INVENTION

In accordance with one embodiment, a ventilation system is provided. The ventilation system includes a range appliance, the range appliance including a cabinet and an air curtain assembly, the air curtain assembly including a first conduit defined in the cabinet and having an inlet and an outlet, the air curtain assembly further including a first fan operable to flow air through the first conduit. The ventilation system further includes a vent appliance spaced from the range appliance, the vent appliance defining a second conduit having an inlet and an outlet, the vent appliance further including a second fan operable to flow air through the second conduit. The ventilation system further includes a controller in communication with the first fan and the second fan, the controller operable to correlate a fan speed of the second fan with a fan speed of the first fan such that a volumetric flow rate through the second conduit is greater than or equal to a volumetric flow rate through the first conduit.

In accordance with another embodiment, a method for operating a ventilation system is provided. The method includes receiving a fan speed of a first fan of a range appliance, the first fan operable to flow air through a first conduit of an air curtain assembly of the range appliance, the first conduit defined in a cabinet of the range appliance. The method further includes determining a corresponding fan speed for a second fan, the second fan operable to flow air through a second conduit of a vent appliance. The method further includes outputting the corresponding fan speed to the second fan. The corresponding fan speed for the second fan is correlated with the fan speed of the first fan such that a volumetric flow rate through the second conduit is greater than or equal to a volumetric flow rate through the first conduit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
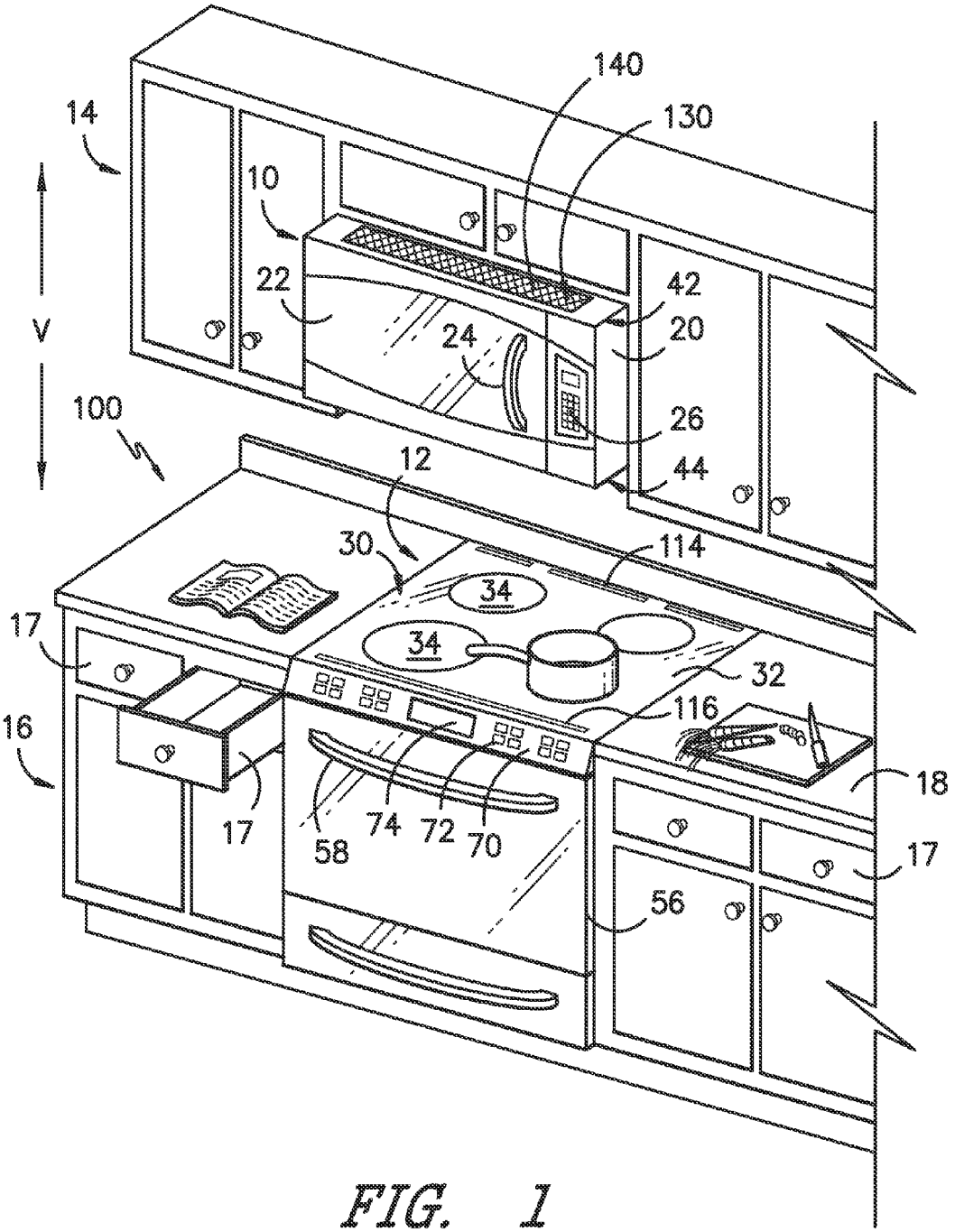
FIG. 1 provides a perspective view of a ventilation system in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a microwave appliance 10 according to an exemplary embodiment of the present subject matter mounted to an upper set of kitchen cabinets 14 above a range appliance 12, e.g., along a vertical direction V. Microwave appliance 10 shown in FIG. 1 is commonly referred to as an over-the-range microwave. It should be understood that, in alternative exemplary embodiments, the present subject matter may be used in any other suitable microwave appliance.

As discussed above, microwave appliance 10 is mounted to upper set of kitchen cabinets 14. Upper set of kitchen cabinets 14 is positioned above a base set of kitchen cabinets 16, e.g., along the vertical direction V. Base set of kitchen cabinets 16 includes countertops 18 and drawers 17. Microwave appliance 10 is positioned above base set of kitchen cabinets 16, e.g., along the vertical direction V. Range appliance 12 is received within base set of kitchen cabinets 16 below microwave appliance 10. In particular, a cooktop 30 of range appliance 12 is positioned, e.g., directly, below microwave appliance 10 along the vertical direction V. Microwave appliance 10 can include features such as an air handler or fan, as discussed herein, that can draw cooking vapors and/or smoke away from cook top 30 and out of the kitchen containing microwave and range appliances 10 and 12.

Microwave appliance 10 is configured for receipt of food items for cooking. In particular, microwave appliance 10 includes a cabinet or casing 20 and a door 22 that permits selective access to an interior of microwave appliance 10 and casing 20. Door 22 includes a handle 24 that a user can pull to open door in order to insert food items into microwave appliance 10. Microwave appliance 10 also includes user interface features 26 that permit a user to make selections for cooking of food items, e.g., a duration of a cooking cycle of microwave appliance 10 and/or a power setting for the cooking cycle of microwave appliance 10.

Figure 2:
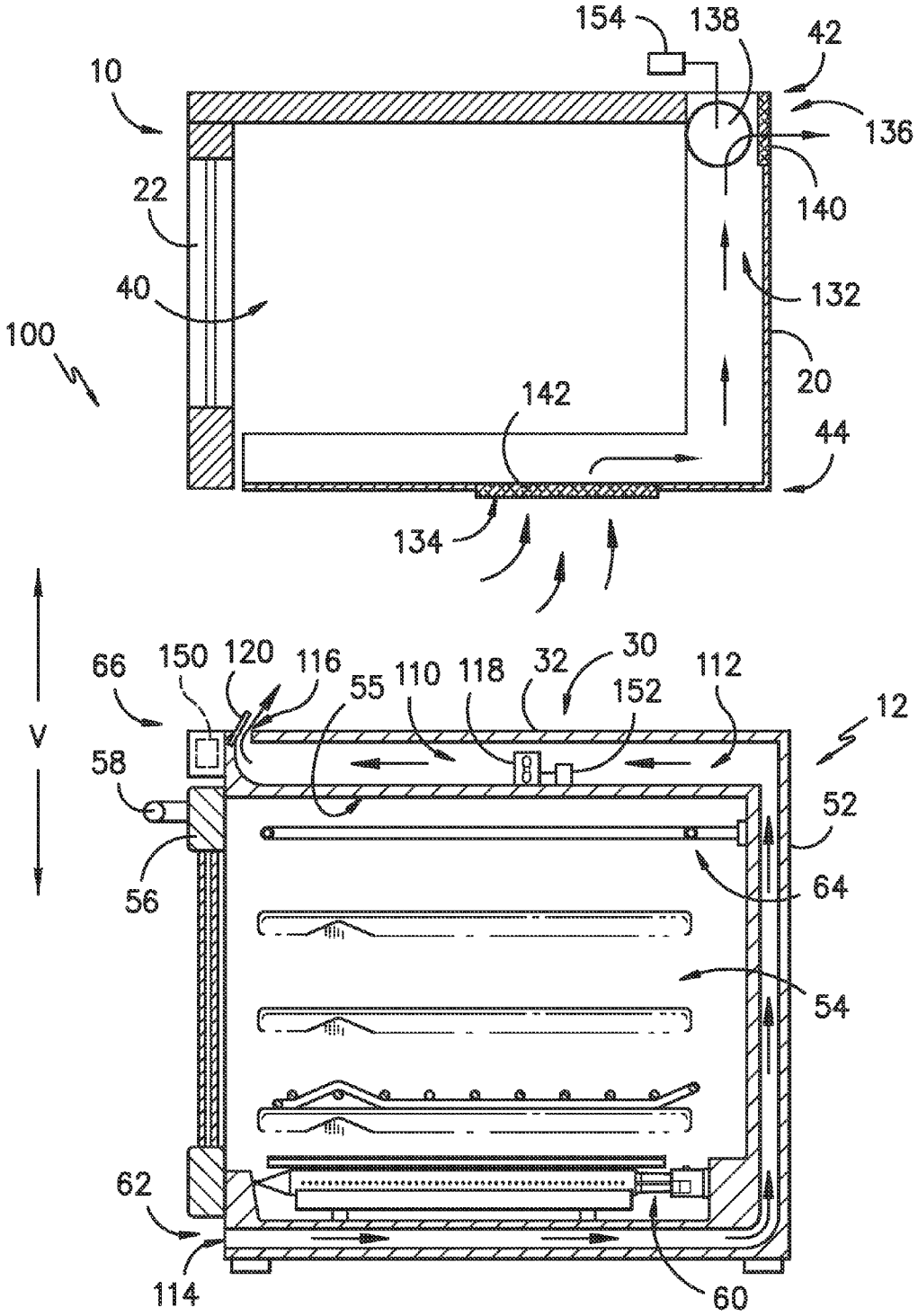
FIG. 2 provides a side cross-sectional view of a ventilation system in accordance with one embodiment of the present disclosure.

FIG. 2 provides a side, sectional view of microwave appliance 10. As illustrated, casing 20 extends between a top portion 42 and a bottom portion 44, e.g., along the vertical direction V. Thus, top and bottom portions 42 and 44 of casing 20 are spaced apart from each other, e.g., along the vertical direction V. Casing 20 defines a cooking chamber 40 configured for receipt of food items for cooking. Door 22 of microwave appliance 10 permits selective access to cooking chamber 40 of casing 20. In particular, door 22 of microwave appliance 10 is selectively adjustable between an open position (not shown) and a closed position (FIGS. 1 and 2). In the closed position, door 22 of microwave appliance 10 hinders access to cooking chamber 40 of casing 20. Conversely, door 22 of microwave appliance 10 permits access to cooking chamber 40 of casing 20 in the open position. A user can pull on handle 24 of door 22 of microwave appliance 10 in order to shift door 22 from the closed position shown in FIG. 2 to the open position.

Figure 3:
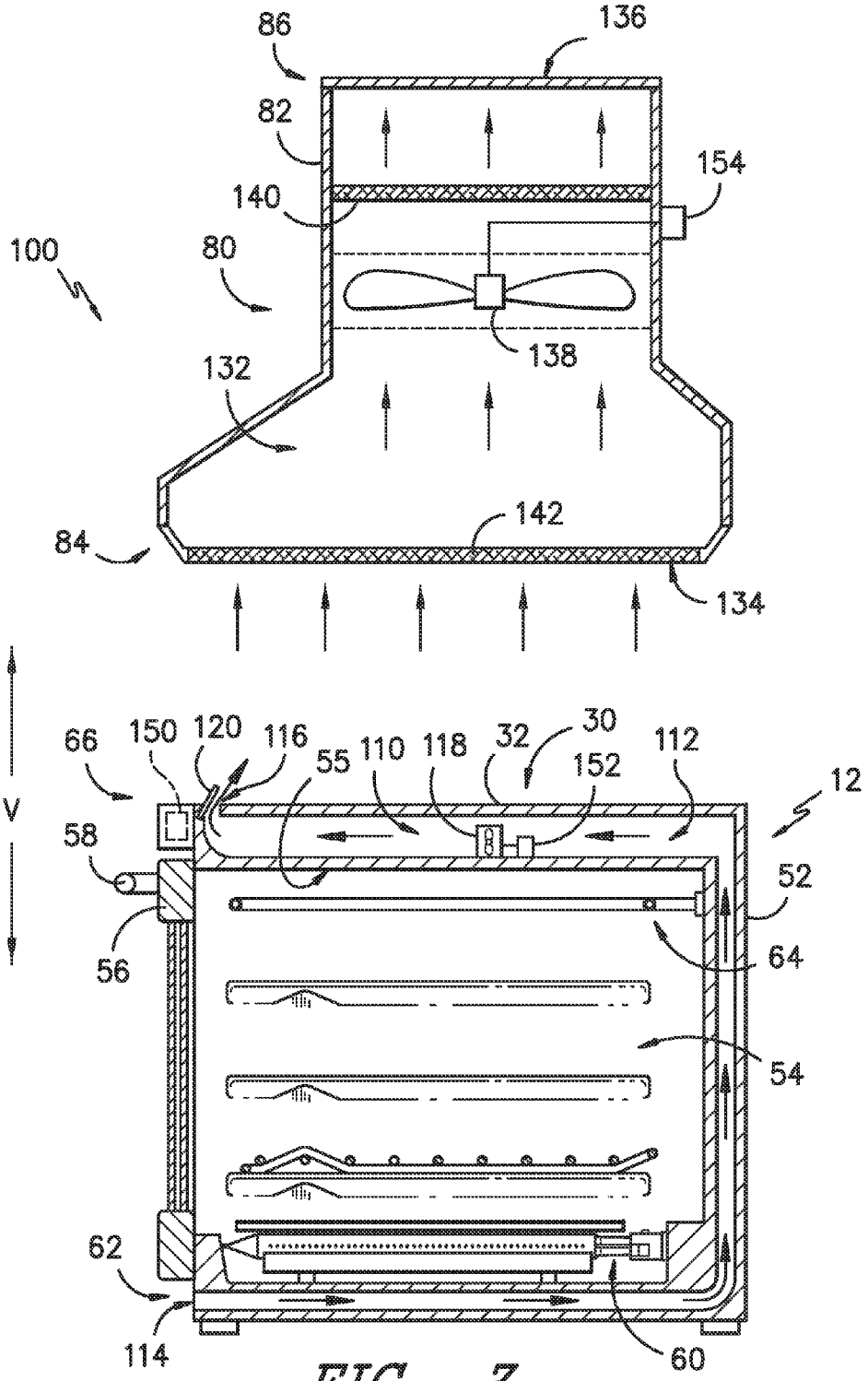
FIG. 3 provides a side cross-sectional view of a ventilation system in accordance with another embodiment of the present disclosure.

Still referring to FIG. 2 as well as FIG. 3, a side, sectional view of range appliance 12 is also provided. Range appliance 12 generally includes a cooking assembly. The cooking assembly may include one or more heating elements. For example, in some embodiments, the cooking assembly, and thus the range appliance 12 includes an insulated cabinet 52 with an interior cooking chamber 54 defined by an interior surface 55 of cabinet 52. Cooking chamber 54 is configured for the receipt of one or more food items to be cooked. Range appliance 12 includes a door 56 rotatably mounted to cabinet 52, e.g., with a hinge (not shown). A handle 58 is mounted to door 56 and assists a user with opening and closing door 56 in order to access cooking chamber 54. For example, a user can pull on handle 58 to open or close door 56 and access cooking chamber 54.

A gas fueled or electric bottom heating element 60 (e.g., a gas burner or a bake gas burner) is positioned in cabinet 52, e.g., at a bottom portion 62 of cabinet 12. Bottom heating element 60 is used to heat cooking chamber 54 for both cooking and cleaning of range appliance 12. The size and heat output of bottom heating element 60 can be selected based on the e.g., the size of range appliance 12.

A top heating element 64 is also positioned in cooking chamber 54 of cabinet 12, e.g., at a top portion 66 of cabinet 12. Top heating element 64 is used to heat cooking chamber 54 for both cooking/broiling and cleaning of range appliance 12. Like bottom heating element 60, the size and heat output of top heating element 64 can be selected based on the e.g., the size of range appliance 12. In the exemplary embodiment shown in FIG. 2, top heating element 64 is shown as an electric resistance heating element. However, in alternative embodiments, a gas, microwave, halogen, or any other suitable heating element may be used instead of electric resistance heating element 64. It should be generally understood that any suitable heating element may be utilized for both the top and bottom heating elements.

Referring again to FIG. 1, the cooking assembly, and thus the range appliance 12 may additionally or alternatively include a cooktop 30. Cooktop 30 may be disposed on the cabinet 52. As show, cooktop 30 may include a top panel 32. By way of example, top panel 32 may be constructed of glass, ceramics, enameled steel, and combinations thereof. Heating assemblies 34, which in this embodiment are electric heating assemblies but in alternative embodiments may be gas burners or induction assemblies, may be mounted, for example, below the top panel 32. While shown with four heating assemblies 34 in the exemplary embodiment of FIG. 1, cooktop 30 may include any number of heating assemblies 34 in alternative exemplary embodiments. Heating assemblies 34 can also have various diameters. For example, each heating assembly of heating assemblies 34 can have a different diameter, the same diameter, or any suitable combination thereof.

Range appliance 12 may further include a user interface panel 70, which may as shown be located within convenient reach of a user of the range appliance 10. User interface panel 70 is generally a component that allows a user to interact with the range appliance 12 to, for example, turn various heating elements (such as heating elements 40, 42 and heating elements of heating assemblies 34) on and off, adjust the temperature of the heating elements, set built-in timers, etc. A user interface panel 70 may include, for example, one or more user interface features 72 and a graphical display 74. The user interface features 72 may be, for example, buttons, knobs, touchscreen features, or any other suitable components that facilitate user interaction therewith. A user may interact with the user interface features to provide various commands to the range appliance 12. Graphical display 74 may generally deliver certain information to the user, which may be based on user selections and interaction with the user interface features 72, such as whether a particular heating element is activated and/or the level at which the heating element is set.

Referring now to FIGS. 1 through 3, ventilation systems 100 are generally provided. A ventilation system 100 may include a range appliance 12 and a vent appliance. In some embodiments, as discussed herein, the vent appliance may be a microwave appliance 12. In other embodiments, as discussed herein, the vent appliance may be a hood. In general, the volumetric flow rates of venting apparatus of the range appliance 12 and vent appliance may advantageously be correlated to facilitate improved flow through the vent appliance, and to prevent the vent appliance from being overwhelmed by excess exhaust fumes, etc. during operation. Typically, such correlation is accomplished by correlating the fan speeds of fans utilized with the venting apparatus of the range appliance 12 and vent appliance. The volumetric flow rates are thus correlated, via the fan speeds, such that the volumetric flow rate through a venting conduit of the vent appliance is always greater than or equal to a volumetric flow rate through a venting conduit of the range appliance 12.

As discussed, the range appliance 12 may include a cabinet 52. The range appliance 12 may further include an air curtain assembly 110. The air curtain assembly 102 may generally provide an air flow that directs exhaust fumes from the range appliance 12 towards the vent appliance, which may be spaced from and above (such as in the vertical direction V) the range appliance 12. Air curtain assembly 102 may further provide additional advantages, such as blocking or cooling oil splash during range appliance 12 operation. Air curtain assembly 110 may be 110 may include a first conduit 112 that is defined in the cabinet 52. In some embodiments, at least a portion of the first conduit 112 may, for example, be generally positioned between the cooking chamber 52 and the cooktop 30, such as in the vertical direction V. The first conduit 112 may further include an inlet 114 and an outlet 116. The inlet 114 and outlet 116 may, for example, be defined in the cooktop 30, such that airflow through the first conduit 112 may flow into and from the first conduit 112 through the cooktop 30. Air curtain assembly 102 may further include a first fan 118 which is operable to flow air through the first conduit 112. The first fan 118 may, for example, be disposed within the conduit 112. Still further, air curtain assembly 110 may include a shield 120. The shield 120 may be disposed proximate the outlet 116 during operation of the air curtain assembly 102, and may direct air flowing from the outlet 116 in a particular direction, such as generally towards the vent appliance, as illustrated. Shield 120 may in some embodiments be retractable, such as through an opening in the cooktop 30 as illustrated.

The vent appliance may include a second conduit 132 through which air may flow. As illustrated in FIGS. 2 and 3, for example, second conduit 132 may have an inlet 134 and an outlet 136. The vent appliance may further include a second fan 138 which is operable to flow air through the second conduit 132. The second fan 138 may, for example, be disposed within the conduit 132. Still further, the vent appliance may include an air filter 140 positioned within the second conduit 132 and/or a grease filter 142 positioned within the second conduit 132.

As discussed, in some embodiments, the vent appliance is microwave appliance 10. Referring to FIG. 2, in these embodiments, inlet 134 may be positioned at or adjacent bottom portion 44 of casing 20, e.g., such that inlet 134 generally faces cooktop 30 of the range appliance 12. Conversely, outlet 136 may be positioned at or adjacent top portion 42 of casing 20, e.g., such that outlet 136 faces away from cooktop 30 of the range appliance 12. Thus, inlet 134 and outlet 136 of circulation conduit 46 are spaced apart from each other, e.g., along the vertical direction V. The second conduit 132 may generally extend around the cooking chamber 40 between the inlet 134 and outlet 136

Referring to FIG. 3, in other embodiments a hood 80 may be provided as an alternative to microwave appliance 10. The hood 80 may include a casing 82, which may extend between a bottom portion 84 and a top portion 86 generally along the vertical direction V. Inlet 134 may be positioned at or adjacent bottom portion 84 of casing 82, e.g., such that inlet 134 generally faces cooktop 30 of the range appliance 12. Conversely, outlet 136 may be positioned at or adjacent top portion 86 of casing 82, e.g., such that outlet 136 faces away from cooktop 30 of the range appliance 12. Thus, inlet 134 and outlet 136 of circulation conduit 46 are spaced apart from each other, e.g., along the vertical direction V.

Referring to FIGS. 2 and 3, grease filter 142 may be positioned within second conduit 132. In particular, grease filter 142 may be positioned at or adjacent inlet 134. It should be understood that in alternative exemplary embodiments, grease filter 142 may be positioned at any other suitable location. Grease filter 142 can assist with removing or filtering grease or other large particles from air flow into the conduit 132 (and exhaust fumes thereof) as the air flow passes through grease filter 142. Grease filter 142 may for example be constructed with an aluminum mesh or a baffle assembly.

Additionally or alternatively, an air filter 140 may be positioned within second conduit 132 such that air flow within circulation conduit 132 passes through air filter 140. In exemplary embodiments as illustrated, air filter 140 is positioned at or adjacent to outlet 136. It should be understood that in alternative exemplary embodiments, air filter 140 may be positioned at any other suitable location.

As illustrated, air filter 140 in exemplary embodiments positioned downstream of grease filter 142 with respect to the air flow through the second conduit 132. In such a manner, grease filter 142 can filter grease and other large particles from the air flow before the air flow passes through air filter 140. Grease filter 142 can improve a lifetime of air filter 140 by removing such contaminants from the air flow rather than air filter 140. Thus, grease filter 142 can be configured for removing relatively large particles from the air flow, and air filter 140 can be configured for removing relatively small particles from the air flow. Air filter 140 can be any suitable filter or mechanism for removing particles from the air flow. For example, air filter 140 may be a charcoal air filter, a high-efficiency particulate air filter, or an electrostatic air filter.

As further illustrated in FIGS. 2 and 3, a controller 150 may be in communication with the first fan 118 and the second fan 138. Controller 150 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. User interface features 26 and 72, as well as fans 118, 138 and other components of ventilation system 100 (such as sensors, as discussed herein) may be in communication with controller 150 via one or more signal lines or shared communication busses. It should be understood that such communication may be through any suitable wired or wireless connection.

The controller 150 may be operable to correlate a fan speed of the second fan 138 with a fan speed of the first fan 118. In particular, the controller 150 may correlate the fan speeds of the first and second fans 118, 138 such that a volumetric flow rate through the second conduit 132 is greater than a volumetric flow rate through the first conduit 112. Such correlation advantageously provides improved flow through the vent appliance, and prevents the vent appliance from being overwhelmed by excess exhaust fumes, etc. during operation of the ventilation system 100. For example, use of the controller 150 ensures that during operation, the volumetric flow rate through the second conduit 132 is constantly greater than or equal to the volumetric flow rate through the first conduit 112, such that the second conduit 132 can accept and flow therethrough the air flow from the first conduit 112. Accordingly, exhaust fumes that are flowed from the range appliance 12 towards the vent appliance are properly flowed through the second conduit 132, and issues with such fumes not being contained by the vent appliance are reduced or eliminated.

In exemplary embodiments, the range appliance 12 may include a first sensor 152 that is in communication with and between the first fan 118 and the controller 150. Further, the vent appliance may include a second sensor 154 that is in communication with and between the second fan 138 and the controller 150. Suitable sensors may be or include, for example, current or voltage sensors or any other suitable sensors or measurement apparatus. Such communication may be via a suitable wired or wireless connection. The first sensor 152 may be operable to measure the fan speed of the first fan 118, and the second sensor 154 may be operable the measure the fan speed of the second fan 138. These fan speeds may be received by the controller 150 from the sensors 152, 154, and may facilitate the required fan speed correlation by the controller 150.

Additionally or alternatively, sensors may be provided for measuring flow characteristics of the air flow through the first and second conduits 112, 132. Suitable sensors may be or include, for example, revolutions-per-minute ("RPM") sensors, tachometers, or any other suitable sensors or measurement apparatus. Flow characteristics may include, for example, the pressure or force of air flow through the conduits 112, 132. Such sensors may be in communication with the controller 150, and flow characteristics may be received by the controller 150 from the sensors and may facilitate the required fan speed correlation by the controller 150.

The controller 150 may correlate the fan speeds based on real time calculations that correlate with the corresponding volumetric flow rates, or such correlations may be experimentally determined. In one embodiment, for example, a predetermined fan speed correlation table may be utilized to determined appropriate fan speeds. Specifically, such table may be utilized to determine appropriate second fan 138 fan speeds based on real time first fan 118 fan speeds. The fan speed correlations in the predetermined fan speed correlation table, which may be programmed into the controller 150, may be experimentally determined to provide the appropriate volumetric flow rates. In other words, such fan speed relationships contained in the table may be experimentally determined to ensure that for a given first fan 118 fan speed, the corresponding second fan 138 fan speed may be such that the volumetric flow rate through the second conduit 132 is greater than the volumetric flow rate through the first conduit 112.

In other embodiments, correlation of the fan speed of the second fan 138 with the fan speed of the first fan 118 may simply be based on a selected speed level for the first fan 118. For example, the first fan 118 and the second fan 138 may each be adjustable between at least two speeds, as discussed below. Correlation may simply involve the selection by the controller 150 of a lower speed setting for the second fan 138 than the selected speed setting of the first fan 118, without the need for sensors measuring those speeds.

Accordingly, in some embodiments, controller 150 may be operable to receive a fan speed of the first fan 118, determine a corresponding fan speed for the second fan 118, such as based on a predetermined fan speed correlation table (using the first fan 118 fan speed as an input into the table and having a corresponding second fan 118 fan speed as an outlet), and output the corresponding fan speed to the second fan 138.

As stated, it should be noted that both the fan speed of the first fan 118 and the fan speed of the second fan 138 may be adjustable. For example, such fan speeds may be adjustable between at least two speeds. Three, four, five or more fan speeds may further be utilized for each fan 118, 138. Further, in some embodiments, a single user interface feature, such as a user interface feature 72 of the range appliance 12, may advantageously be operable to actuate the first fan 118 and the second fan 138. Notable, a user may be able to set a speed (off, low, high; off, low, medium, high; etc.) for the fans 118. First fan 118 may operate at this speed, and the second fan 138 may be operated at a fan speed correlated with the first fan 118 as discussed herein.

It should be noted that additional sensors, for example temperature sensors such as thermometers, may be utilized in the system 100. Temperature sensors may communicate temperatures, such as of the exhaust fumes at the outlet 116 and inlet 134 or of the air generally at various locations in the ventilation system 100 (such as in or on the range appliance 12 and the vent appliance) to the controller 150. The controller 150 may utilize these temperatures, and the resulting changes in air densities, to adjust the correlation between the fan speed of the first fan 118 and the fan speed of the second fan 138 as required.

Figure 4:
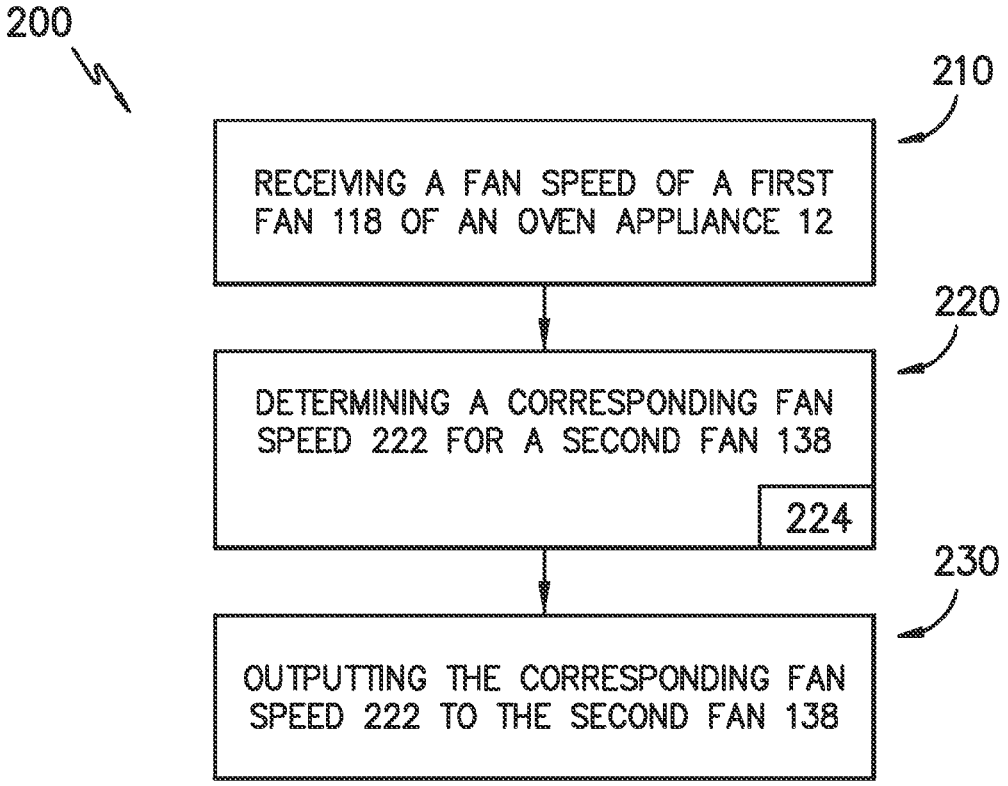
FIG. 4 is a flow chart illustrating a method for operating a ventilation system in accordance with one embodiment of the present disclosure.

Referring to FIG. 4, the present disclosure is further directed to methods for operating ventilation systems 100, as indicated by reference numeral 200. The steps of such methods may, for example, advantageously be performed by a controller 150. A method may include, for example, the step 210 of receiving a fan speed 212 of a first fan 118 of a range appliance 12. The fan speed 212 of the first fan 118 may for example be received from a first sensor 152.

The method may further include, for example, the step 220 of determining a corresponding fan speed 222 for a second fan 138. In exemplary embodiments, as discussed, herein, the corresponding fan speed is determined based on a predetermined fan speed correlation table 224.

The method may further include, for example, the step 230 of outputting the corresponding fan speed 222 to the second fan 138. The corresponding fan speed 222 for the second fan 138 may be correlated with the fan speed 212 of the first fan 118 such that a volumetric flow rate through a second conduit 132 is greater than or equal to a volumetric flow rate through a first conduit 112, as discussed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A ventilation system defining a vertical direction, the ventilation system comprising:

a range appliance, the range appliance comprising a cooktop including a top panel, a cabinet, and an air curtain assembly, the top panel being disposed on the cabinet, the air curtain assembly comprising a first conduit defined in the cabinet and having an inlet and an outlet, the air curtain assembly further comprising a first fan operable to flow air through the first conduit;

a vent appliance spaced from the range appliance, the vent appliance including a casing extending from a bottom portion and a top portion, the casing defining a second conduit having an inlet and an outlet, the vent appliance further comprising a second fan operable to flow air through the second conduit; and a controller in communication with the first fan and the second fan, the controller operable to correlate a fan speed of the second fan with a fan speed of the first fan such that a volumetric flow rate through the second conduit is greater than or equal to a volumetric flow rate through the first conduit, wherein the outlet of the first conduit is defined through the top panel and faces away from the cooktop, wherein the inlet of the second conduit is defined through the bottom portion of the casing and faces the cooktop, and wherein the inlet of the second conduit is spaced apart from the outlet of the first conduit.

2. The ventilation system of claim 1, wherein the fan speed of the first fan and the fan speed of the second fan are each adjustable between at least two speeds.

3. The ventilation system of claim 1, further comprising a user interface feature in communication with the controller, the user interface feature operable to actuate the first fan and the second fan.

4. The ventilation system of claim 1, wherein the cabinet further defines a cooking chamber, and wherein at least a portion of the first conduit is generally positioned between the cooking chamber and the cooktop.

5. The ventilation system of claim 1, wherein the vent appliance is a microwave appliance.

6. The ventilation system of claim 1, wherein the vent appliance is a hood.

7. The ventilation system of claim 1, wherein the controller is operable to receive the fan speed of the first fan, determine a corresponding fan speed for the second fan based on a predetermined fan speed correlation table, and output the corresponding fan speed to the second fan.

8. The ventilation system of claim 1, wherein the vent appliance further comprises an air filter positioned within the second conduit.

9. The ventilation system of claim 1, wherein the vent appliance further comprises a grease filter positioned within the second conduit.

10. The ventilation system of claim 1, wherein the range appliance comprises a first sensor in communication between the first fan and the controller, wherein the vent appliance comprises a second sensor in communication between the second fan and the controller, and wherein the first sensor and the second sensor are operable to measure fan speeds of the first fan and the second fan.

11. A method for operating a ventilation system, the method comprising:

receiving a fan speed of a first fan of a range appliance, the first fan operable to flow air through a first conduit of an air curtain assembly of the range appliance, the first conduit defined in a cabinet of the range appliance, the first conduit including an outlet defined through a top panel of the cabinet of the range appliance to direct air away from the top panel;

determining a corresponding fan speed for a second fan, the second fan operable to flow air through a second conduit of a vent appliance, the second conduit including an inlet defined through a bottom portion of the vent appliance to face the top panel and receive air from the outlet of the first conduit, the inlet of the second conduit being spaced apart from the outlet of the first conduit in a vertical direction; and outputting the corresponding fan speed to the second fan, wherein the corresponding fan speed for the second fan is correlated with the fan speed of the first fan such that a volumetric flow rate through the second conduit is greater than or equal to a volumetric flow rate through the first conduit.

12. The method of claim 11, wherein the corresponding fan speed is determined based on a predetermined fan speed correlation table.

13. The method of claim 11, wherein the fan speed of the first fan is adjustable between at least two speeds.

14. The method of claim 11, wherein the cabinet of the range appliance further defines a cooking chamber and the range appliance further comprises a cooktop, and wherein at least a portion of the first conduit is generally positioned between the cooking chamber and the cooktop.

15. The method of claim 11, wherein the vent appliance is a microwave appliance.

16. The method of claim 11, wherein the vent appliance is a hood.

17. The method of claim 11, wherein the fan speed of the first fan is received from a first sensor, the first sensor in communication between the first fan and the controller and operable to measure a fan speed of the first fan.

18. A ventilation system defining a vertical direction, the ventilation system comprising:

a range appliance, the range appliance comprising a cooktop including a top panel, a cabinet defining a cooking chamber below the top panel, and an air curtain assembly, the air curtain assembly comprising a first conduit extending between an inlet and an outlet, the inlet being defined through the cabinet below the outlet, the outlet being defined through the top panel and facing away from the cooktop, the air curtain assembly further comprising a first fan operable to flow air through the first conduit, and wherein at least a portion of the first conduit is generally positioned between the cooking chamber and the top panel;

a vent appliance spaced from the range appliance, the vent appliance including a casing extending from a bottom portion and a top portion, the casing defining a second conduit having an inlet and an outlet, the inlet of the inlet of the second conduit being defined through the bottom portion of the casing and facing the cooktop such that the inlet of the second conduit is spaced apart from the outlet of the second conduit, the vent appliance further comprising a second fan operable to flow air through the second conduit; and a controller in communication with the first fan and the second fan, the controller operable to correlate a fan speed of the second fan with a fan speed of the first fan such that a volumetric flow rate through the second conduit is greater than a volumetric flow rate through the first conduit, wherein the range appliance comprises a first sensor in communication between the first fan and the controller, wherein the vent appliance comprises a second sensor in communication between the second fan and the controller, and wherein the first sensor and the second sensor are operable to measure fan speeds of the first fan and the second fan.

* * * * *